US005607018A

United States Patent [19]

Schuh

[11] Patent Number: 5,607,018

[45] Date of Patent: *Mar. 4, 1997

[54] VISCID OIL WELL COMPLETION

[76] Inventor: Frank J. Schuh, 5808 Wavertree, Plano, Tex. 75093

[ * ] Notice: The portion of the term of this patent subsequent to Mar. 1, 2011, has been disclaimed.

[21] Appl. No.: 315,181

[22] Filed: Sep. 29, 1994

Related U.S. Application Data

[63] Continuation of Ser. No. 985,903, Dec. 4, 1992, abandoned, which is a continuation-in-part of Ser. No. 678,725, Apr. 1, 1991, Pat. No. 5,289,881.

[51] Int. Cl.[6] ..... E21B 43/24

[52] U.S. Cl. ..... 166/303; 166/50; 166/62

[58] Field of Search ..... 166/303, 272, 166/57, 62, 50, 97.5, 316

[56] References Cited

U.S. PATENT DOCUMENTS

| | | | |
|---|---|---|---|
| 3,115,187 | 12/1963 | Brown | 166/313 X |
| 3,399,623 | 9/1968 | Creed | 166/62 |
| 3,511,282 | 5/1970 | Willhite | 138/113 |
| 3,613,792 | 10/1971 | Hyde et al. | 166/57 X |
| 3,779,602 | 12/1973 | Beard et al. | 166/303 X |
| 3,861,469 | 1/1975 | Bayless et al. | 166/303 |
| 3,994,340 | 11/1976 | Anderson et al. | 166/50 X |
| 4,099,570 | 7/1978 | Vandergrift | 166/50 X |
| 4,116,275 | 9/1978 | Butler et al. | 166/50 X |
| 4,421,163 | 12/1983 | Tuttle | 166/59 |
| 4,458,758 | 7/1984 | Hunt, III et al. | 166/272 |
| 4,460,044 | 7/1984 | Porter | 166/50 X |
| 4,480,695 | 11/1984 | Anderson | 166/50 |
| 4,532,994 | 8/1985 | Toma et al. | 166/303 |
| 4,565,245 | 1/1986 | Mims et al. | 166/50 |
| 4,605,069 | 8/1986 | McClaflin et al. | 166/372 X |
| 4,640,359 | 2/1987 | Livesey et al. | 166/276 |
| 4,696,345 | 9/1987 | Hsueh | 166/50 X |
| 4,726,420 | 2/1988 | Weeks | 166/372 X |
| 4,878,539 | 11/1989 | Anders | 166/50 X |
| 4,942,926 | 7/1990 | Lessi | 166/385 |
| 5,054,551 | 10/1991 | Duerksen | 166/50 X |
| 5,080,172 | 1/1992 | Jones | 166/303 |
| 5,141,054 | 8/1992 | Alameddine et al. | 166/50 X |
| 5,148,869 | 9/1992 | Sanchez | 166/303 |

OTHER PUBLICATIONS

Michael Prats "Thermal Recovery", Society of Petroleum Engineers, 1988, pp. 6–15 (Chapter 2) and 72–87 (Chapter 7).

*Primary Examiner*—Hoang C. Dang

*Attorney, Agent, or Firm*—Morgan L. Crow, P.E.

[57] ABSTRACT

A horizontal well completion apparatus and method for heavy, viscous oil in a producing zone (114) are disclosed using a single well. Hot injection fluid is injected into an injection string (120), and emitted through steam distribution holes (133) in the lower portion (120) of the injection string into the casing (116) near perforations (118). A packer (126) separates the upper well annulus (140) from the lower well annulus (142) Insulation (121) surrounds injection tubing string (120) between the packer (126) and the well head (111). Perforations (118) in the horizontal portion (112) of the well allow heated oil to flow into the lower annulus 42 in the horizontal portion (112) of the well where is picked up by the injected fluid and lifted to the surface of the well by a jet pump (128). Temperature and pressure in the lower well annulus (142) are controlled by the temperature and pressure of the injection fluid, and the pumping rate of the produced fluids.

12 Claims, 4 Drawing Sheets

10
16
31
34
35
37
38
18
14
33
110
111
114
116
118
120
121
122
124
126
128
130
132
136
138
140

VISCID OIL WELL COMPLETION

CROSS REFERENCE TO APPLICATION

This application is a continuation of application Ser. No. 07/985,903, filed Dec. 4, 1992, now abandoned, which application is a continuation-in-part of my patent application Ser. No. 07/678,725, filed Apr. 1, 1991, now U.S. Pat. No. 5,289,881.

BACKGROUND OF THE INVENTION

The Field of the Invention relates to the drilling, completion and production of wells drilled into formations containing heavy, viscous hydrocarbons. These hydrocarbons may be referred to as bitumen or tar. In one embodiment, the invention relates to the drilling of a well bore substantially vertically or slanted downwardly, then curving the well bore out into a substantially horizontal portion, then thermal treatment and production of the viscous hydrocarbons from the producing formation. In other embodiments, the invention relates to the drilling of a well bore substantially vertically downwardly through one or more producing formations which contain viscous hydrocarbons, then thermal treatment and production of the viscous hydrocarbons from the producing formation.

The heavy, viscous hydrocarbons are valuable for refining. The refined products can be used as the basis for road paving, plastics and can be refined to derive light hydrocarbons useful for fuels and oils. Such formations as may be near the earth surface can be strip mined to recover the hydrocarbons. Many producing zones, however, are deeper, and may be a few hundred feet or several thousand feet below the earth surface. For purposes of this specification, producing zone and producing formation have the same meaning. For purposes of this specification, tubing placed in a well casing may also be referred to as a tubing string, and surface means at or near the earth surface unless otherwise referenced. For the purposes of this specification, perforation or perforations includes the use of slotted liners and pipe that is perforated or has drilled holes prior to being positioned in a well bore.

Heavy hydrocarbon, also known as heavy crude oil, can have American Petroleum Institute (API) density from about 8 up to 20 or more. Lower API density numbers indicate greater specific gravity. API 10 has a specific gravity of 1. Such heavy crude oils are very viscous, and are essentially solid at in situ (in place) temperatures.

Recovery of such heavy crude oil has been accomplished in the past by heating. Steam is been injected through a well into a producing formation for a time, then the well is produced. This process is referred to as the "huff and puff" method. With several vertical wells drilled into a zone, several wells may be produced with the "huff and puff" process. After sufficient oil has been removed from the formation, communication may be established from one well to another. Then a continuous flood of steam may be injected into one well. A mixture of heated oil, condensate and steam may then be produced from an adjacent well. This process is known a continuous steam flood.

The Related Prior Art includes U.S. Pat. No. 4,565,245, in which Mims et al. teach the method and apparatus of a system of single well completion for carrying a hot stimulating agent into a tar sand from the remote end of the well. A progressively movable barrier is used to extend the flow path pattern in the producing formation. No provision is made to lift fluids from the remote end of the casing. The use of a barrier in the casing indicates the use of a heated flooding process rather than the use of heat conduction in combination with gravity in this invention to cause hydrocarbons to flow to the well bore. Mims also teaches that movement of the barrier is needed during the producing life of the formation.

In U.S. Pat. No. 4,640,359, Livesay teaches the method and apparatus for use in a single well for conducting a hot thermal stimulating medium to the remote end of the well. An expandable divertar forms a barrier which is progressively lengthened to cause the stimulating medium to sweep progressively increasing lengths of the producing formation.

SUMMARY OF THE INVENTION

There is disclosed the system of completion and production of heavy oil from a well comprising a well casing disposed in a well bore. The well and casing may have a substantially horizontal portion disposed in an earth formation containing heavy oil. The well casing has perforations in the horizontal portion, or in the producing zone of a vertical well. A well head is provided at the top end of the well casing. An injection tubing string is extended from the well head into the producing zone. A packer seals the casing between the perforations and the well head. A production tubing string extends from the well head through and seals with the packer, and a choke restricts flow in the injection string. The choke is positioned beyond at least a portion of the perforations in the casing, whereby steam may be circulated into the injection string, through the choke, out of the injection tubing string, through a portion of the perforations, enter the production tubing string and return to the well head through the production tubing string. My invention may also include a jet pump in the production string above the packer. A jet pump implies a power fluid string extending from the well head operably connected to the jet pump to power the jet pump. In this invention, the horizontal portion of a well bore and well casing is desirably disposed in the lower portion of the earth formation containing heavy oil.

DESCRIPTION OF THE PREFERRED EMBODIMENT

Figures 1, 2:
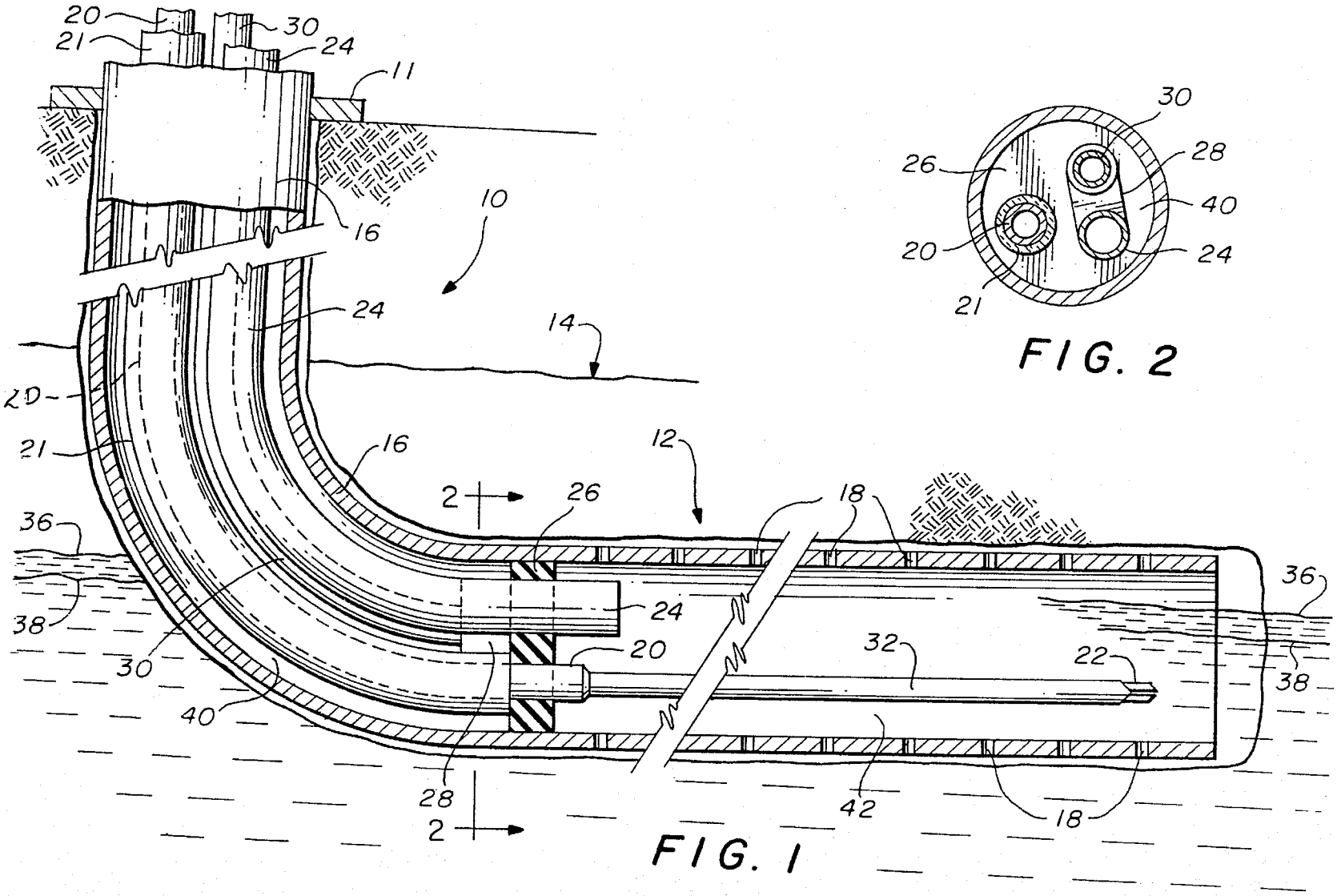
FIG. 1 is a perspective view of the preferred embodiment in this invention.
FIG. 2 is a cross section of the well of the preferred embodiment of this invention.

In FIG. 1 there is shown generally at 10 a perspective view of a well according to this invention. The well is drilled from the surface of the earth down in a generally vertical direction, then deviated by any of a number of methods well known in the industry. The well is curved so that the generally horizontal portion 12 of the well is drilled within the producing zone 14 and generally parallel to the bottom limit of the producing zone. The horizontal section 12 of the well can be of considerable length, up to 5000 feet or more. The reservoir also known as the producing zone 14 most desirable for application of my invention is a high permeability clean sandstone that contains a very viscous oil. The producing zone desirably is consolidated, rather than being, for example, loose sand. A producing zone of loose unconsolidated sand can be produced according to this invention by making provision to control the flow of the sand. These methods and apparatus are well known in the industry. A steel casing string 16 is run into the well bore and cemented in place as is well known in the industry. A well head 11 is installed at the surface of the earth to seal the well casing and to seal and support any tubing strings suspended within the casing. The casing is then perforated with perforations 18 along the length of the portion of the casing 16 within the producing zone. The far greater number of perforations in the casing draining a far greater volume of producing zone in near proximity to the well bore are advantages within the prior art that are gained by the horizontal well completion as described in this paragraph.

A steam injection tubing string 20 inserted into the well casing 16 is fitted with a choke 22 at or near the end of the tubing 20 remote from the surface. A production tubing string 24 is inserted into the casing 16 to conduct the produced hydrocarbons, condensate and possibly steam from the bottom of the casing 16. A packer 26 seals between the casing 16, the injection tubing 20 and the production tubing 24. The packer 26 has a flow passage sealed to the production string and communicating the production string through the packer. The packer 26 is positioned in the casing 16 near the perforations 18 between the perforations 18 and the surface. The packer 26 thereby seals and seals between the annulus 40 above the packer 26 and the annulus 42 below the packer where there are perforations 18. The annulus 40 is the space inside the casing 16, above the packer 26 and outside any tubing strings in the casing 16. The portion of the Steam injection tubing 20 in the annulus 40 is surrounded by thermal insulation 21 to reduce the transfer of heat from the steam in tubing 20 to the formation adjacent to the well. See FIG. 2. Any fluid left in the annulus 40 above the packer at the start of steam injection would eventually be expected to boil away from heat transferred from the injection tubing 20. As an option, this annulus 40 may be evacuated during the completion procedure by methods well known in the industry, therefore these procedures will not be described here. The air or vapor left in the annulus 40 performs an additional insulating effect to reduce heat loss from the injection tubing 20 in addition to the effect of insulation 21.

In some cases, the injection steam pressure will be sufficient to lift the produced oil and condensate to the surface without the need of a pump to lift these fluids. In cases where the formation is so weak as to be unable to contain sufficient pressure to lift the fluids to the surface, some type of artificial lift, such as a pump will be required.

A jet pump 28 is the preferred device to lift the fluids from the bottom of the well to the surface. A jet pump is a device well known in the industry. A power fluid line 30 connects the surface to the jet pump 28. Fluid pumped from the surface down power fluid line 30 passes through a venturi in the jet pump 28 as is known in the industry. The venturi reduces the pressure at the inlet to the jet pump 28 to mix any fluids present at the pump inlet with the power fluid and lift the mixture to the surface through the production tubing string 24. In this manner, the jet pump 28 can lift the heated hydrocarbons, condensate, steam, even solids, and any gas without any moving mechanical parts in the well. Moving mechanical parts as in a mechanical pump would have frequent malfunctions due to the orientation of the well bore, the temperature at the pump and problems from solids carried by the produced fluids. A person skilled in the art can appreciate that although the target producing zone 14 is consolidated, loose, unconsolidated sand can be entrained and pumped to the surface with the jet pump 28.

A conventional steam generator at the surface, not shown, is used to heat the water for injection into the well through injection tubing 20. When water is heated, the maximum temperature to which the liquid can be heated is dependent on the pressure of the liquid. The water may be heated to the vaporization temperature for the injection pressure. If sufficient heat is added to the water in the steam generator, the water may be vaporized into steam. A feed water pump for the steam generator, not shown, supplies the pressure to move the water through the steam generator, to the injection tubing 20, and through the choke 22, through the perforations 18 in the casing. It can be readily seen by these skilled in the art that the water or steam pressure will be reduced upon passing through the flow restriction of the choke. Upon this pressure reduction, the saturation temperature of the water will be reduced, and therefore, the temperature of the water will be reduced to this saturation temperature. The pressure in the formation will be controlled by the flow rate of steam and water injected and the flow rate of the production flow as controlled by the jet pump 28, in combination with the pressure drop of the flow through choke 22 through the perforations 18, through the producing zone 14, and to the jet pump 28.

The steam injection tubing 20 in the annulus 40 is surrounded by thermal insulation 21 as mentioned above. The substantially horizontal portion of the injection tubing 32 beyond the packer 26 is not thermally insulated. Initially, the annulus 42 below the packer would be filled with steam or water, depending on the temperature and pressure. Heat will be transferred from the injection tubing 32 into the producing zone 14. The heat will reduce the viscosity of the heavy hydrocarbons in place so the steam, water and condensate flow will cause the hydrocarbons to flow from the from the producing zone 14 by gravity to the jet pump where the mixture will be lifted to the surface. There, the hydrocarbons may be separated from the water and recovered for use. Startup and production according to this invention will be described hereinafter.

Referring now to FIG. 2, the cross section of the preferred embodiment of the invention shows the casing 16, the steam injection tubing string 20, the production tubing string 24 and the power fluid line 30 for the jet pump. Thermal insulation 21 surrounds injection tubing string 20.

The packer 26 with two flow passages may be selected from several types of hardware known and currently available in the industry. The production tubing string and power tubing string may be lowered into the casing individually in sequence according to known technology.

Figure 3:
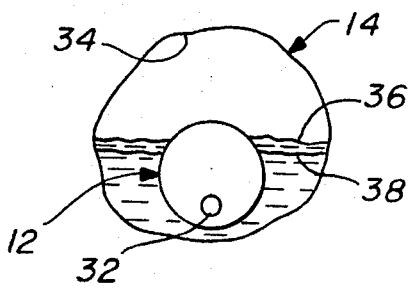
FIG. 3 is a cross section of the well and a portion of the producing zone early in the life of the well according to the preferred embodiment in this invention.

FIG. 3 illustrates the cross section of the horizontal portion of the well and horizontal portion of the casing 16 and a portion of the producing zone 14. A small volume of the producing zone 14 shows to have had the heavy oil liquified, flowed into the well horizontal portion of the casing 16 and been produced. Steam vapor flow is represented by arrows 33, as the steam rises through the permeable oil bearing formation. As the steam comes in contact with the oil in place in producing zone 14, the steam transfers heat to the oil and formation and the steam condenses into water. The steam condensate represented by arrows 35 flows downwardly by gravity flow. As the viscid oil in place is heated, the viscosity is reduced so that gravity causes the reduced viscosity oil, represented by arrows 37, to flow downwardly, flowing to the horizontal portion of the casing 16 positioned near the bottom of the producing formation 14.

Figure 4:
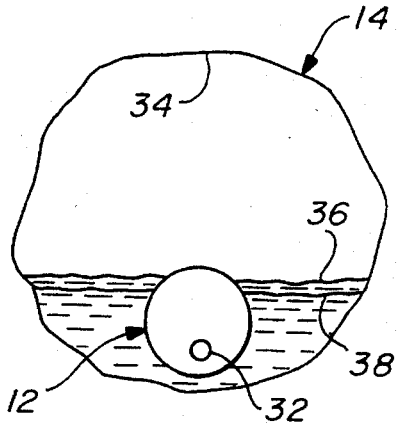
FIG. 4 is a cross section of the well and a portion of the producing zone later in the life of the well according to the preferred embodiment in this invention.

FIG. 4 shows the same cross section as FIG. 3 later in life. A larger volume of oil has been recovered from the producing zone 14.

Figure 5:
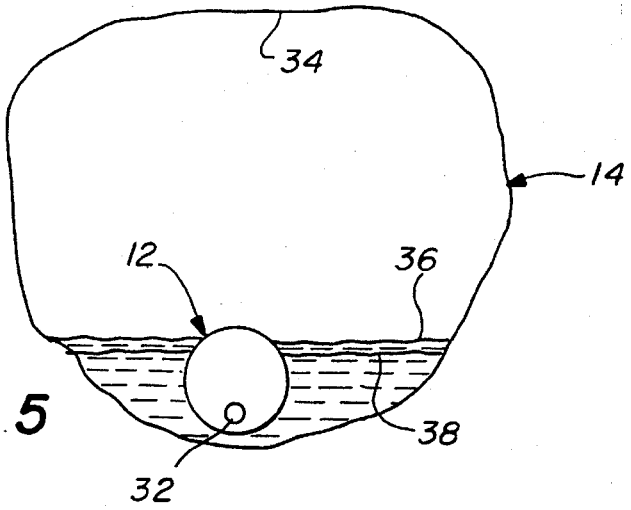
FIG. 5 is a cross section of the well and a portion of the producing zone late in the life of the well according to the preferred embodiment in this invention.

FIG. 5 shows the same cross section as FIG. 3 and FIG. 4 late in life. The heavy oil has been recovered up to the upper limit 34 of the producing zone 14. A different formation not containing hydrocarbons will lie above and define the upper limit 34 of the producing zone 14.

Figure 6:
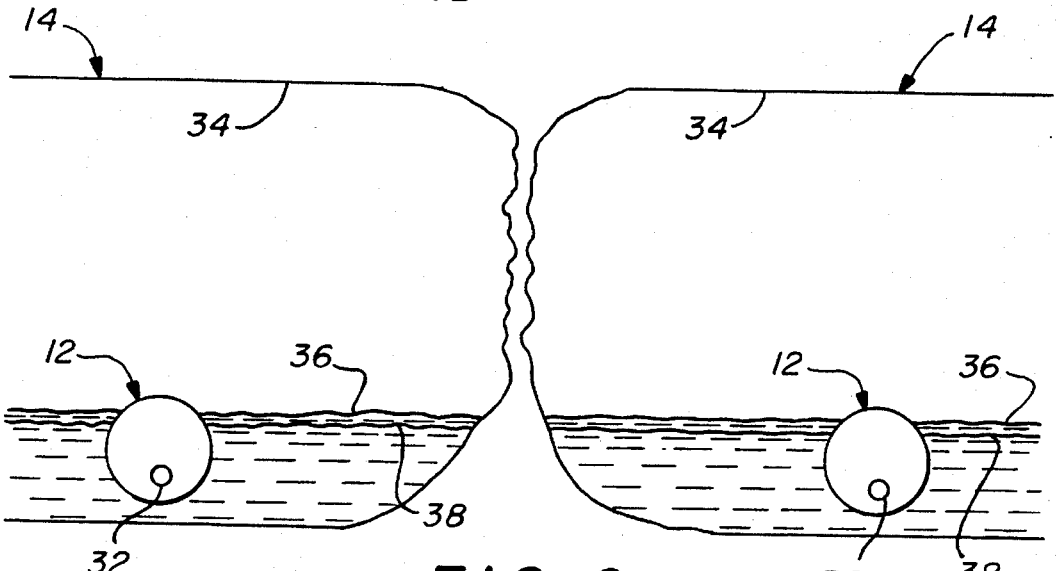
FIG. 6 is a cross section of two adjacent wells and a portion of the producing zone late in the life of the well according to the preferred embodiment in this invention.

FIG. 6 illustrates recovery which might be achieved by two parallel wells according to the invention. Very high percentages of recovery of viscous materials can be achieved economically by use of this invention as compared to conventional methods.

Figures 7, 8, 9:
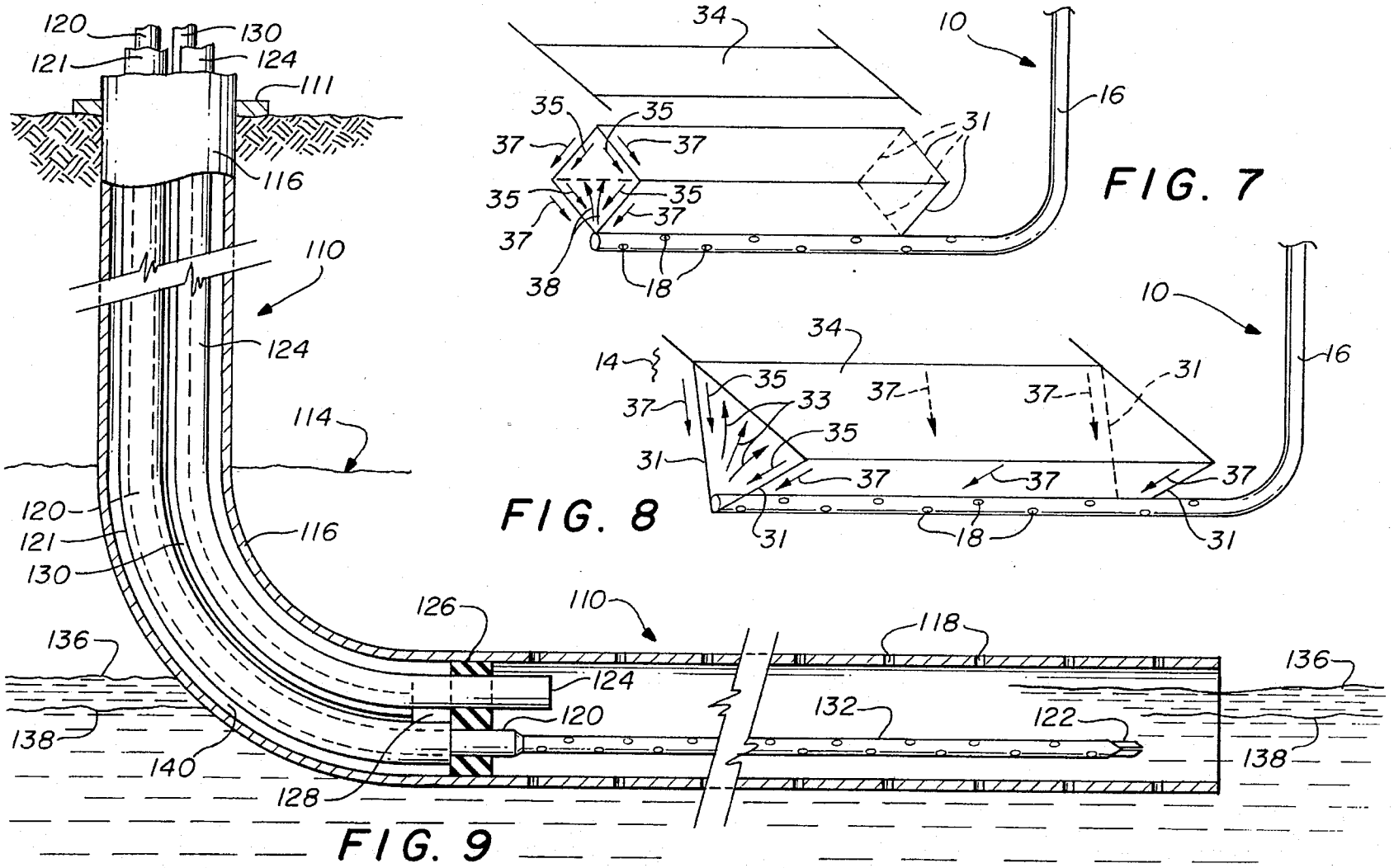
FIG. 7 is a perspective view of a well according to this invention with the earth formation cut away, showing a portion of the producing formation.
FIG. 8 is a perspective view of the well as illustrated in the FIG. 7 at a later stage in the production life.
FIG. 9 is a perspective view of an alternate embodiment in this invention.

FIG. 7 illustrates the well generally at 10. The horizontal portion 12 of the well bore is in the lower portion of the producing formation 14. Steam vapor flow is represented by arrows 33, as the steam rises through the permeable oil bearing formation. As the steam comes in contact with the oil in place in producing zone 14, the steam transfers heat to the oil and formation and the steam condenses into water. The interfaces where this heat transfer and change of steam to condensate and change of the heavy oil to a flowable liquid is represented by the envelope of surfaces 31. The steam condensate represented by arrows 35 flows downwardly by gravity flow. As the viscid oil in place is heated, the viscosity is reduced so that gravity causes the reduced viscosity oil, represented by arrows 37, to flow downwardly, flowing to the horizontal portion of the casing 16 positioned near the bottom of the producing formation 14. The heated oil and condensate can enter casing 16 through perforations 18.

FIG. 8 illustrates the same well in FIG. 7, later in the producing life. The steam vapor 33 has reached the upper limit 34 of the producing zone 14. Steam vapor 33 is still transferring heat to viscid oil lateral to the horizontal portion 12 if the well. Steam vapor 33 condenses into condensate 35 when heat from the steam is transferred to the formation 14 lateral to the well. Reduced viscosity oil 37 flows by gravity down to the horizontal portion 12 of the well, where it enters the casing 16 through perforations 18.

FIG. 9 illustrates the cross section of an alternate embodiment of the invention and shows the casing 116, the steam injection tubing string 120, the production tubing string 124 and the power fluid line 130 for the jet pump. Thermal insulation 121 surrounds injection tubing string 120.

Figure 10:
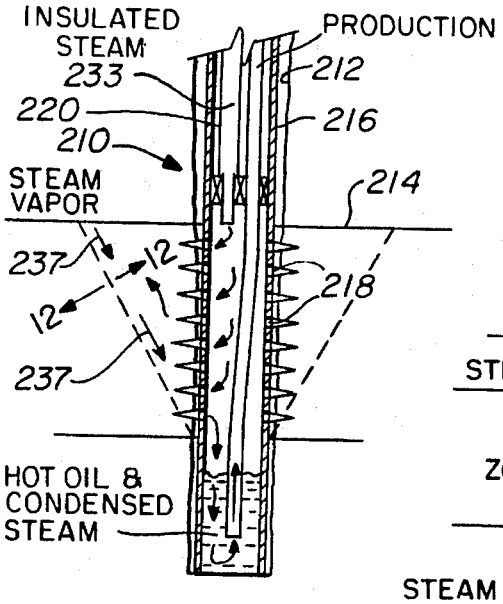
FIG. 10 is a partial elevation section of a second alternate embodiment

FIG. 10 illustrates a cross section of a second alternate embodiment of the invention. A vertical well bore 212 penetrates a producing zone 214. Steam 233 is injected through injection string 220. Casing 216 has perforations 218 to pass the steam under pressure into the formation. The steam heats the formation 214 to reduce the viscosity of the viscid oil in the formation 214. The oil 237 flows into the casing 216 through the perforations 218 to be picked up by the production string and brought to the surface of the well for recovery.

Figure 11:
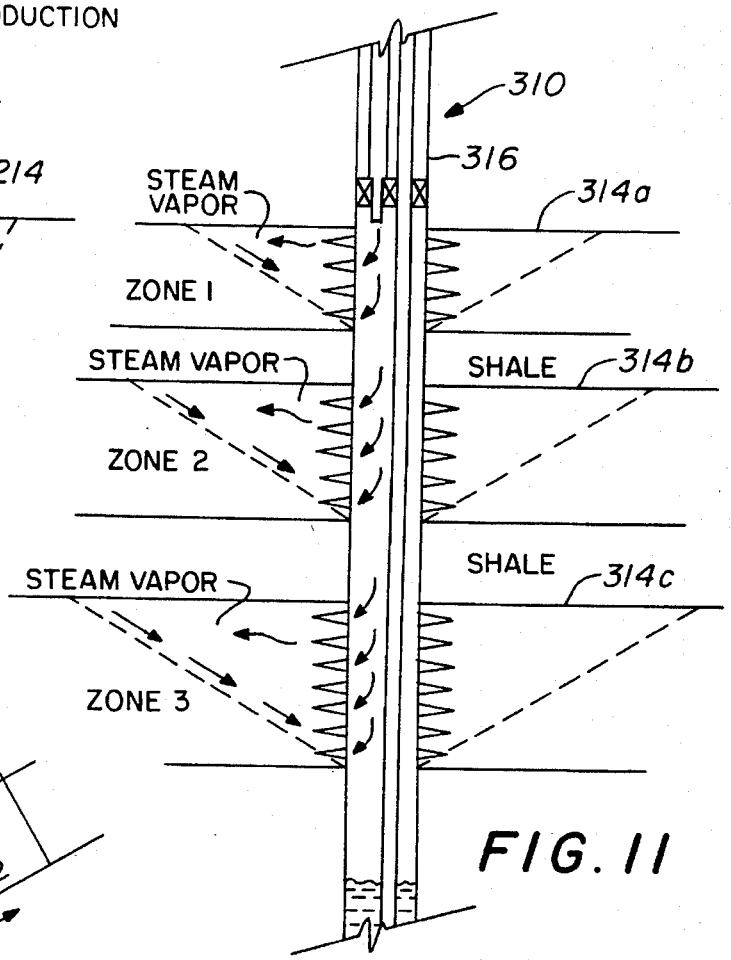
FIG. 11 is a third alternate embodiment.

FIG. 11 illustrates a cross section of a third embodiment of the invention. This embodiment is similar to layout and operation in the alternate embodiment illustrated in FIG. 10, except a multiplicity of producing reservoirs of viscid oil may be stimulated into production.

Figure 12:
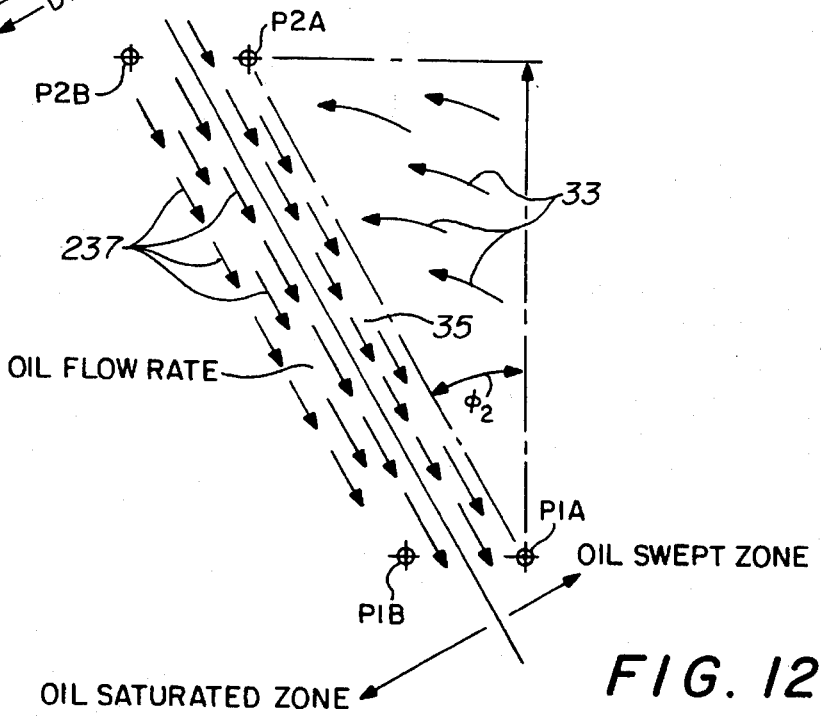
FIG. 12 is a cross section of a steam vapor, steam condensate, heated oil and viscid oil interface.

FIG. 12 is an enlarged cross section of the interface at Section 12—12 in FIG. 2. Steam vapor flow is represented by arrows 33, as the steam rises through the permeable oil bearing formation. As the steam comes in contact with the oil in place in producing zone 14, the steam transfers heat to the oil and formation and the steam condenses into water. The steam condensate represented by arrows 35 flows downwardly by gravity flow. As the viscid oil in place is heated, the viscosity is reduced so that gravity causes the reduced viscosity oil, represented by arrows 37, to flow downwardly, flowing to the horizontal portion of the casing 16 positioned near the bottom of the producing formation 14. The heated oil and condensate can enter casing 16 through perforations 18. The steam vapor in the formation could be about 0.01 pressure gradient in PSI/FT (pounds per square inch pressure per foot of height), depending on the pressure of the steam. Viscid oil of API 10 gravity has a pressure gradient of 0.433 PSI/FT. For steam vapor at about 700 PSI the temperature of the steam vapor column is 503 degrees Fahrenheit and has a pressure gradient of 0.01 PSI/FT. For example, for 700 PSI steam, each foot of height H in FIG. 12, the steam column pressure P1A will be greater that pressure P2A by 0.01 PSI (pounds per square inch). For the same height, the oil column pressure P1B will be greater than pressure P2B by 0.433 PSI. For each foot of height in the producing zone, the difference in the pressure of the steam vapor and 10 degree API oil would be 0.433–0.01 or 0.423 PSI. For greater vertical dimensions in producing formations, the pressures will be in proportion. Thus it can bee seen that the lighter weight steam will rise in the permeability of the depleted portion of the producing zone, and the higher column pressure will cause the reduced viscosity oil to flow down by gravity force into the perforations in the casing, along with the condensate from the steam. Once the fluids flow into the casing, they can be recovered by a normal flow, jet pump, rod pump, or other pumps known to the industry.

Figure 13:
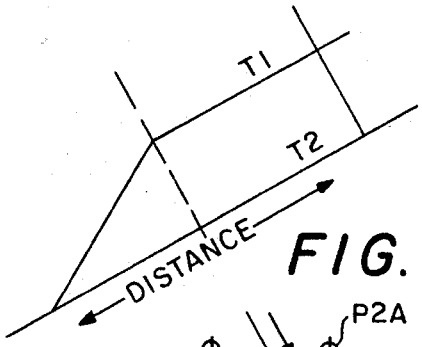
FIG. 13 is a graph of distance along the base of FIG. 12 versus temperature.

FIG. 13 is a graph of distance along the base of FIG. 12 versus temperature. The X axis of this graph is the distance perpendicular to the steam-viscid oil interface of any embodiment of this invention. The Y axis is temperature in the producing formation. T1 is the saturated steam temperature of the steam at the steam pressure maintained in the formation. T2 is the normal geothermal temperature of the unheated formation.

OPERATION OF THE PREFERRED EMBODIMENT

Upon installation of the completion equipment as illustrated in FIG. 1 and FIG. 2, production may be started. Steam is injected into the injection string 20 at the surface. An efficient plan is to pump the water into a steam generator (not shown), then into the injection string 20, at such a flow rate as to establish sufficient pressure to heat the water to a temperature to heat the producing zone 14 to a temperature sufficient to liquify the heavy oil in the producing zone 14. Heat transfers from the horizontal portion 32 of the injection string. Since this portion of the injection string is not insulated, heat is transferred into the producing zone 14 throughout the entire length of the horizontal section 32. This horizontal section 32 may be 5000 feet or more in length. When the steam or water passes through the choke 22, the pressure is reduced beyond the choke. Power fluid is pumped into the jet pump power fluid string 30. Fluids in the annulus 42 of the casing below the packer are picked up by the jet pump 28 and pumped the surface. The pressure, and therefore the temperature, in the horizontal portion 12 of the casing is controlled by the flow rate of the injection fluid going in, and the flow rate of the power fluid for the jet pump controlling the flow rate of the fluids removed from the horizontal section 12 of the casing. For example, if the pressure was atmospheric, the steam would condense at 212 degrees Fahrenheit. At a pressure of 500 psi, the condensing (saturated) temperature of water is 467 degrees F. Unless the well were very shallow, and without the jet pump, the bottomhole pressure would be quite high, and the saturated steam temperature would be quite high. The steam injection string 20 would have approximately the same temperature as the injection temperature. The production string would receive the fluids at the saturation temperature of the flow after the pressure drop at the choke and with the pressure controlled by the flow induced by the jet pump.

As the heavy oil in the producing zone 14 is heated by the injection fluid, gravity will perform an important role in causing the oil to flow into the perforations 18 in the horizontal portion 12. The flow of the injected fluids from the far end of the well to the jet pump 28 will sweep the oil which flows into and through the horizontal portion of the casing 16 to the jet pump 28 to be lifted to the surface for separation from the power fluid and injection fluid. As the heated fluid passes through the choke to a lower pressure, some of the water will flash into steam, and rise to the uppermost volume available. As the steam heats the viscous oil at the top of the open reservoir volume, the heated oil will have reduced viscosity and flow along with the condensed steam down through the reservoir to the well through the perforations into the horizontal portion 12 of the casing where the steam and condensate flow will push the liquids along to the end of the production string. In the case of a very shallow well, it will flow back to the surface. In case of a deeper well, the jet pump will pick up the oil and condensate mixture, and lift them to the surface.

The great advantage of this invention is that a circulation passage through the horizontal portion 12 of the well casing is provided. The flow of the hot steam, water and condensate will heat the formation adjacent the horizontal portion of the casing 16. As this oil is heated, it will flow by gravity through the perforations 18 into the horizontal portion of the casing 16 where it is picked up by the steam and condensate flow to the production string for lift to the surface. By controlling the producing rate, it is possible to withdraw all of the condensate and flowable oil that enters the horizontal portion of the casing 16. The steam cavity in the producing zone 14 will continually expand and cause the oil in contact with the steam to heat and flow by gravity into the perforations 18 into the horizontal portion of the casing 16 and be recovered as described above.

With this invention, the maximum economically feasible depth for steam production stimulation is greater than with a conventional vertical well. With this invention, the length of the well in which heat from the steam is lost is a smaller fraction of the total length of the length than with a vertical completion.

Referring to FIGS. 3, 4, 5 and 6, it is assumed that the oil has greater API gravity than 10, therefore the oil is lighter than the condensate water. I anticipate that in the operation of a well according to this assumption and this invention can result in a pool of condensate water and a layer of liquid hydrocarbon floating atop the condensate at the bottom of the producing zone 14. A steam vapor to oil interface 36 could exist between the pool of oil and the steam vapor in the upper volume of the producing zone 14, if the producing zone has sufficient permeability. An oil to water interface 38 could exist between the pool of oil and the water in the lower volume of the producing zone 14, if the producing zone has sufficient permeability. If the producing zone has lower permeability, the vapor-liquid interface would not be so distinctly defined.

Producing a well according to this assumption and invention would require regulation of the injection flow rate and production flow rate so that the layer of oil would enter the casing through perforations 18. Production of condensate only would indicate the bottom of the oil layer has risen above the casing. The production rate would need to be increased relative to the injection rate so the oil-condensate interface 38 would fall to the casing level and cause oil to be picked up by the jet pump 28 and pumped to the surface. If hotter condensate or steam were produced, this would indicate the production volume is too high and the production rate would need to be reduced relative to the injection rate. The relative rates described in this paragraph can be accomplished by increasing the flow that is too low, or decreasing the flow that is too high, or a combination of these adjustments.

OPERATION OF THE PREFERRED EMBODIMENT

In FIG. 9 there is shown generally at 110 a perspective view of an alternate embodiment well according to this invention. The well is drilled from the surface of the earth down in a generally vertical direction, then deviated by any of a number of methods well known in the industry. The well is curved so that the generally horizontal portion 112 of the well is drilled within the producing zone 114 and generally parallel to the bottom limit of the producing zone. The horizontal section 112 of the well can be of considerable length, up to 5000 feet or more. The reservoir also known as the producing zone 114 most desirable for application of my invention is a high permeability clean sandstone that contains a very viscous oil. The producing zone desirably is consolidated, rather than being, for example, loose sand. A producing zone of loose unconsolidated sand can be produced according to this invention by making provision to control the flow of the sand. These methods and apparatus are well known in the industry. A steel casing string 116 is run into the well bore and cemented in place as is well known in the industry. A well head 111 is installed at the surface of the earth to seal the well casing and to seal and support any tubing strings suspended within the casing. The casing is then perforated with perforations 118 along the length of the portion of the casing 116 within the producing zone. The far greater number of perforations in the casing draining a far greater volume of producing zone in near proximity to the well bore are advantages within the prior art that are gained by the horizontal well completion as described in this paragraph.

A steam injection tubing string 120 inserted into the well casing 116 is fitted with steam distribution holes 133 along the length of the horizontal section 132 of the injection string. A production tubing string 124 is inserted into the casing 116 to conduct the produced hydrocarbons, condensate and possibly steam from the bottom of the casing 116. A packer 126 seals between the casing 116, the injection tubing 120 and the production tubing 124. The packer 126 has a flow passage sealed to the production string and communicating the production string through the packer. The packer 126 is positioned in the casing 116 near the perforations 118 between the perforations 118 and the surface. The packer 126 thereby seals and seals between the annulus 140 above the packer 126 and the annulus 142 below the packer where there are perforations 118. The annulus 140 is the space inside the casing 116, above the packer 126 and outside any tubing strings in the casing 116. The portion of the steam injection tubing 120 in the annulus 140 is surrounded by thermal insulation 121 to reduce the transfer of heat from the steam in tubing 120 to the formation adjacent to the well. The cross section of this embodiment is similar to FIG. 2. Any fluid left in the annulus 140 above the packer at the start of steam injection would eventually be expected to boil away from heat transferred from the injection tubing 120. As an option, this annulus 140 may be evacuated during the completion procedure by methods well known in the industry, therefore these procedures will not be described here. The air or vapor left in the annulus 140 performs an additional insulating effect to reduce heat loss from the injection tubing 120 in addition to the effect of insulation 121.

A jet pump 128 is the preferred device to lift the fluids from the bottom of the well to the surface. A jet pump is a device well known in the industry. A power fluid line 130 connects the surface to the jet pump 128. Fluid pumped from the surface down power fluid line 130 passes through a venturi in the jet pump 128 as is known in the industry. The venturi reduces the pressure at the inlet to the jet pump 128 to mix any fluids present at the pump inlet with the power fluid and lift the mixture to the surface through the production tubing string 124. In this manner, the jet pump 128 can lift the heated hydrocarbons, condensate, steam, even solids, and any gas without any moving mechanical parts in the well. Moving mechanical parts as in a mechanical pump could have frequent malfunctions due to the orientation of the well bore, the temperature at the pump and problems from solids carried by the produced fluids. A person skilled in the art can appreciate that although the target producing zone 114 is consolidated, loose, unconsolidated sand can be entrained and pumped to the surface with the jet pump 128.

OPERATION OF THE ALTERNATE EMBODIMENT

Referring to FIG. 9, operation of the Alternate Embodiment is similar to the operation of the Preferred Embodiment. The difference lies in the absence of a choke 22 and the use of the steam distribution holes 133 in portion 132 of the injection string below the packer 140.

In the alternate embodiment, a tail pipe below the packer has perforations over most of the length in the casing below the packer. Steam is injected in proximity to the extent of the formation traversed by the horizontal portion of the casing. Steam pressure forces contact of the steam to the oil bearing formation, and gravity drains the heated and less viscous oil through perforations into the casing and to the end of the production tubing string.

Steam is injected into the injection string 120 at the surface. An efficient plan is to pump the water into a steam generator (not shown), then into the injection string 120, at such a flow rate as to establish sufficient pressure to heat the water to a temperature to heat the producing zone 114 to a temperature sufficient to liquify the heavy oil in the producing zone 114. Steam flows from the steam distribution holes 133 along the horizontal portion 132 of the injection string. Since this portion of the injection emits steam along the length of the perforations 118 in the casing 116, and is introduced into the producing zone 114 throughout the entire length of the horizontal section 132 through perforations 118. It is preferred in this embodiment that the perforations generally cover the interval of casing 116 where perforations 118 are positioned. This horizontal section 132 may be 5000 feet or more in length. Power fluid is pumped into the jet pump power fluid string 130. Fluids in the annulus 142 of the casing below the packer are picked up by the jet pump 128 and pumped to the surface. The pressure, and therefore the temperature, in the horizontal portion of the casing 116 is controlled by the flow rate of the injection fluid going in, and the flow rate of the power fluid for the jet pump controlling the flow rate of the fluids removed from the horizontal section of the casing 116. For example, if the pressure was atmospheric, the steam would condense at 212 degrees Fahrenheit. At a pressure of 500 psi, the condensing (saturated) temperature of water is 467 degrees F. Unless the well were very shallow, and without the jet pump, the bottomhole pressure would be quite high, and the saturated steam temperature would be quite high. The steam injection string 120 would have approximately the same temperature as the injection temperature. The production string would receive the fluids at the saturation temperature of the flow after the pressure drop in the injection string and with the pressure controlled by the flow induced by the jet pump.

As the heavy oil in the producing zone 114 is permeated by the injection steam, gravity will perform an important role in causing the oil and steam condensate to flow into the perforations 118 in the casing 116. The inflow of the oil and condensate from the formation 114 into substantially the extent of the perforations in the well the jet pump 128 will sweep the oil which flows into and through the casing 116 below the packer 126 to the jet pump 128 to be lifted to the surface for separation from the power fluid and injection fluid. As the steam passes into the casing 116 below the packer 140, the steam will rise to the uppermost volume available. As the steam heats the viscous oil at the top of the open reservoir volume, the heated oil will have reduced viscosity and flow along with the condensed steam down through the reservoir to the well through the perforations into the horizontal portion of the casing where the steam and condensate flow will push the liquids along to the end of the production string. In the case of a very shallow well, it will flow back to the surface. In case of a deeper well, the jet pump will pick up the oil and condensate mixture, and lift them to the surface.

The system of completion for simultaneous and continuous steam injection and production of heavy oil from a single well can comprise a well casing disposed in a well bore, the well bore and well casing having a substantially horizontal portion disposed in an earth formation containing heavy oil, and the well casing having perforations in the horizontal portion. A well head is placed at the top end of the well casing. A packer is installed, sealing the casing between the perforations and the well head. A production tubing string is installed, extending from the well head, sealing with and communicating through the packer. An injection tubing string is installed, extending from the well head, sealing with and a portion of the injection string extending through the packer and extending through at least a portion of the perforations, with the interior of the casing below the packer being void of any barriers such that a continuous annulus is formed between the injection tubing string and the casing throughout the entire length of the portion of the injection tubing string below the packer. Steam distribution holes are provided in the portion of the injection string tubing string extending through the packer and in communication with the perforations in the casing. Means for injecting steam into the injection string are provided, and means for controlling the pressure of the steam and therefore the temperature of steam in the formation are provided. Preferable, the portion of the injection tubing string extending through the packer and extending through at least a portion of the perforations has steam distribution holes in the injection string positioned substantially adjacent the perforations in the casing. This provides steam adjacent the perforations in the casing achieving good distribution of the steam to all the perforations.

The great advantage of this invention is that a circulation passage through the horizontal portion of the well casing 116 is provided. The flow of the hot steam, water and condensate will heat the formation adjacent the casing 116. As this oil is heated, it will flow by gravity through the perforations 118 into the casing 116 where it is picked up by the steam and condensate flow to the production string for lift to the surface. By controlling the producing rate, it is possible to withdraw all of the condensate and flowable oil that enters the casing 116. The steam cavity in the producing zone 114 will continually expand and cause the oil in contact with the steam to heat and flow by gravity into the perforations 118 into the casing 116 and be recovered as described above.

If it is assumed that the oil has a lesser API gravity than 10, therefore the oil is heavier than the condensate water, then the oil will sink below the water, and the water will form a layer on top of the oil. Gravity will then cause the oil to flow to the perforations 18. Then the jet pump can pick up the oil and lift it to the surface.

It will be understood that references to horizontal portions of a well also include a sloping portion of the well for purposes of following a sloping lower boundary of a producing zone. References to horizontal portions of a well also include any sloping portions through a producing zone, and portions of wells that slope because of circumstances at the time the well is drilled.

Referring to FIG. 10, in a second alternate embodiment, the invention is carried out on a single producing zone 214. Casing 216 is placed in the well penetrating and preferably passing through the producing zone 214. Perforations 218 are disposed in the lower portion of the earth formation 214 containing heavy oil. The perforations 214 preferably extend to the lower extent of the producing formation 214. The perforations 214 preferably extend to the upper extent of the producing formation 214. It is more important that the perforations 218 extend to the lower extent of the formation since gravity causes the oil to flow downwardly. Any oil below the perforations 218 will not be essentially unrecoverable. If the perforations 214 do not extend to the top of the producing formation 214, some, if not all of this oil is recoverable since the steam vapor will rise due the pressure and low specific gravity. Gravity will cause the oil above the perforations will flow downwardly due to gravity, and be recovered. I prefer that the perforations extend to the top of the producing formation since the steam, condensate and oil flow will be more efficient through the perforations than through the formation outside casing that is not perforated. In this arrangement, the steam enters the upper portion of the perforations, heats the viscid oil as described earlier. The heated oil can then flow downwardly into the perforations and into the lower portion of the casing which acts as a sump.

In this embodiment it is preferred that the injection string terminate below the packer, but not necessarily extend any further in the annulus below the packer. It is preferred that an injection tubing string extend from the well head, seal with, and extend through the packer to communicate with the casing perforations. It is preferred that a production tubing string extend from the well head, seal with, and extend through the packer to communicate with the casing perforations. The interior of the casing below the packer being void of any barriers such that a continuous annulus is formed between the production tubing string and the casing throughout the entire length of the portion of the production tubing string below the packer.

Variations of the second embodiment could be accomplished with vertical wells as described above, with slant wells where the deviation angle of the well is less than 90 degrees from vertical, and with wells with "horizontal" portions where the "horizontal" portion of a well is deviated less than 90 degrees from vertical. For the purposes of this specification and claims, references to wells includes vertical wells, substantially vertical wells, wells with substantially vertical portions and portions deviated from the vertical, slant wells and combinations of these configurations. For the purposes of this specification and claims, references to heavy, viscid, and viscous oil or crude all have the same meaning.

In any of the alternate embodiments described above, the production tubing string should terminate at or below the deepest perforations, so that gravity will flood the production string intake. In this manner liquids which flow into the liquids flow into the annulus below the packer will flow to the production string intake. As described above, in the alternate embodiments, the injection string will preferably terminate it the upper, preferably, the uppermost point of the annulus below the packer.

In the case of a well as shown in FIG. 1 where the "horizontal" the "horizontal" portion of a well is deviated more than 90 degrees from vertical, it is possible to use the arrangement without the choke. In the production tubing string should terminate with the lower portion, preferably, the lowermost point of the annulus below the packer, which is immediately below the packer, so that gravity will flood the production string intake. In this manner liquids which flow into the annulus below the packer will flow to the production string intake. As described above, in the preferred embodiment, the injection string will preferably terminate at the upper, preferably, the uppermost point of the annulus below the packer which is the far end of the annulus below the packer from the packer.

What I have described is a system of completion for simultaneous and continuous steam injection and production of heavy oil from a single well comprising well casing means disposed in a well bore, the well bore and well casing means disposed in an earth formation containing heavy oil. The well casing means having perforations in communication with the formation containing heavy oil, well head means at the top end of the well casing means, packer means sealing the casing between the perforations and the well head means, tubing string means including production tubing string means extending from the well head means, sealing with and communicating through the packer means, and terminating in the lower portion of the casing below the packer. Injection tubing string means is provided, extending from the well head means, sealing with and extending through the packer means and terminating in the upper portion of the casing below the packer. The interior of the casing below the packer preferably being void of any barriers such that a continuous annulus is formed between the tubing string means and the casing throughout the entire length of the portion of the tubing string means below the packer. Means is provided for injecting steam into the injection tubing string means, and means for controlling the pressure of the steam and therefore the temperature of the steam in the formation, whereby steam is continuously circulated into the injection string means, out of the injection tubing string means, through a portion of the perforated casing means, wherein injection forces drive the steam into the formation where it condenses, heating the heavy oil, reducing the viscosity of the heavy oil, allowing the steam condensate and hot oil to flow downward into the perforated portion of the well casing means where the condensate and oil flow into the production tubing string means and flow through the production tubing string means to the well head means simultaneously with the steam injection. An improved system for completing a well and simultaneously and continuously producing viscous hydrocarbons may be provided, wherein the means for controlling the steam pressure in the hydrocarbon bearing zone further comprises pump means in the production string to lift liquids at a controlled rate from below the packer to the well head. The pump means may include a jet pump, a rod pump, gas lift or other means of artificial lift known in the industry.

Referring to FIG. 11, in a third alternate embodiment shown generally 310, the invention is carried out on multiple producing zones 314*a*, 314*b* and 314*c*. Casing 316 is placed in the well penetrating and preferably passing through the producing zones 314*a*, 314*b* and 314*c*. Perforations 318*a*, 318*b* and 318*c*, respectively, are disposed in the lower portion of the earth formations 314*a*, 314*b* and 314*c* containing heavy oil. The perforations 318*a*, 318*b* and 318*c* preferably extend to the lower extent of each producing formation 314*a*, 314*b* and 314*c*, respectively. The perforations 318*a*, 318*b* and 318*c* preferably extend to the upper extent of each producing formation 314*a*, 314*b* and 314*c*, respectively. It is more important that the perforations 318*a*, 318*b* and 318*c* extend to the lower extent of each formation since gravity causes the oil to flow downwardly. Any oil below the perforations 318*a*, 318*b* and 318*c* in the respective formation will not be essentially unrecoverable. If the perforations 318*a*, 318*b* and 318*c* do not extend to the top of the producing formations 314*a*, 314*b* and 314*c*, respectively, some, if not all of this oil is recoverable since the steam vapor will rise due the pressure and low specific gravity. Gravity will cause the oil above the perforations will flow downwardly due to gravity, to the perforations and be recovered. I prefer that the perforations extend to the top of the producing formation since the steam, condensate and oil flow will be more efficient through the perforations than through the formation outside casing that is not perforated. In this arrangement, the steam enters the upper portion of the perforations, heats the viscid oil as described earlier the heated oil can then flow downwardly into the perforations and into the lower portion of the casing which acts as a sump.

In some fields, there are multiple heavy oil producing formations. In these cases, the well bore and well casing may penetrate at least two earth formations containing heavy oil, with the well casing having perforations in communication with each earth formation containing heavy oil. Oil in place in each producing zone may be heated and caused to flow into the casing as described hereinbefore. One well, then may be used to stimulate and produce heavy oil from a multiplicity of producing formations.

Although only four embodiments of the invention have been illustrated in the accompanying drawings and described in the foregoing Description it will be understood that the invention is not limited to the embodiments disclosed, but is capable of rearrangements, modifications, and substitutions and reversals of parts and elements without departing from the spirit of the invention.

I claim:

1. A system of completion for simultaneous and continuous steam injection and production of heavy oil from a single well comprising:

a well casing disposed in a well bore, the well bore and well casing having a substantially horizontal portion disposed in an earth formation containing heavy oil, and the well casing having perforations in the horizontal portion, a well head at the top end of the well casing, a packer sealing the casing between the perforations and the well head, a production tubing string extending from the well head, sealing with and communicating through the packer, an injection tubing string extending from the well head, sealing with and extending through the packer and extending through at least a portion of the perforations, the interior of the casing below the packer being void of any barriers such that a continuous annulus is formed between the injection tubing string and the casing throughout the entire length of the portion of the injection tubing string below the packer, means for injecting steam into the injection string, and means for controlling the pressure of the steam and therefore the temperature of steam in the formation, comprising a jet pump in the production string, and a power fluid string extending from the well head and operably connected to the jet pump to power the jet pump, and means for controlling the injection rate of steam into the injection string.

2. A system of completion for simultaneous and continuous steam injection and production of heavy oil from a single well comprising:

a well casing disposed in a well bore, the well bore and well casing having a substantially horizontal portion disposed in an earth formation containing heavy oil, and the well casing having perforations in the horizontal portion, a well head at the top end of the well casing, a packer sealing the casing between the perforations and the well head, a production tubing string extending from the well head, sealing with and communicating through the packer, an injection tubing string extending from the well head, sealing with and a portion of the injection string extending through the packer and extending through at least a portion of the perforations, the interior of the casing below the packer being void of any barriers such that a continuous annulus is formed between the injection tubing string and the casing throughout the entire length of the portion of the injection tubing string below the packer, steam distribution holes in the portion of the injection tubing string extending through the packer and in communication with the perforations in the casing, means for injecting steam into the injection string, and means for controlling the pressure of the steam and therefore the temperature of steam in the formation.

3. The system according to claim 2 wherein the means for controlling the pressure and therefore the temperature of steam in the formation includes:

a jet pump in the production string, and a power fluid string extending from the well head and operably connected to the jet pump to power the jet pump.

4. The system according to claim 2 wherein the portion of the injection tubing string extending through the packer and extending through at least a portion of the perforations has steam distribution holes in the injection string positioned substantially adjacent the perforations in the casing.

5. The system according to claim 3 wherein the perforations are disposed in the lower portion of the earth formation containing heavy oil.

6. The system according to claim 2 wherein the well bore and well casing penetrate at least two earth formations containing heavy oil, with the well casing having perforations in communication with each earth formation containing heavy oil.

7. A system of completion for simultaneous and continuous steam injection and production of heavy oil from a single well comprising:

a well casing disposed in a well bore, the well bore and well casing being disposed in an earth formation containing heavy oil, and the well casing having perforations where disposed within said formation, a well head at the top end of the well casing, a packer sealing the casing between the perforations and the well head, a production tubing string extending from the well head, sealing with and communicating through the packer, and extending to an inlet below the perforations, an injection tubing string extending from the well head, sealing with and communicating through the packer, and in communication with said perforations, at least one of said strings extending beyond at least a portion of the well casing containing said perforations, the interior of the casing beyond the packer, forming a continuous annulus between the tubing string thereat and the casing coextensively beyond the packer, means for continuously injecting steam into the injection string outward through said perforations into said formation where the steam condenses, heating the oil, and allowing the oil to flow by gravity inward through said perforations into the casing annulus, and lift apparatus for producing the heavy oil from said well through the inlet of said production tubing string simultaneously with injecting the steam.

8. A system of completion for simultaneous and continuous steam injection and production of heavy oil from a single well comprising:

a well casing disposed in a well bore, the well bore and well casing being disposed in an earth formation containing heavy oil, and the well casing having perforations where disposed within said formation, a well head at the top end of the well casing, a packer sealing the casing between the perforations and the well head, a production tubing string extending from the well head, sealing with and communicating through the packer and extending to an inlet below the perforations where oil is to be received, an injection tubing string extending from the well head, sealing with and extending through the packer and a portion of the injection string in communication with said perforations, the interior of the casing beyond the packer, forming a continuous annulus between the injection tubing string and the casing throughout the entire length of the portion of the injection tubing string beyond the packer, means for injecting steam into the injection string to maintain a pressure relation between said annulus and said formation and to heat said heavy oil, enabling said heated oil and steam condensate to be received by gravity into said casing annulus through said perforations, and lift apparatus for producing the heavy oil from said casing annulus through the inlet of said production string simultaneously with injecting of the steam.

9. The system according to claim 8 wherein the means for producing the heavy oil from said casing annulus through the production tubing string, while injecting the steam comprises:

a jet pump in the production string, and a power fluid string extending from the well head and operably connected to the jet pump to power the jet pump.

10. The system according to claim 8 wherein the portion of the injection tubing string extending through the packer and extending through at least a portion of the perforations has steam distribution holes in the injection string positioned substantially adjacent the perforations in the casing.

11. The system according to claim 9 wherein the perforations are disposed in the lower portion of the earth formation containing heavy oil.

12. The system according to claim 8 wherein the well bore and well casing penetrate a plurality of formations containing heavy oil, with the well casing having perforations in communication with at least two of said earth formations containing heavy oil.

* * * * *